US009190008B2

(12) United States Patent
Pyun et al.

(10) Patent No.: US 9,190,008 B2
(45) Date of Patent: Nov. 17, 2015

(54) GATE DRIVING MODULE, DISPLAY APPARATUS HAVING THE SAME AND METHOD OF DRIVING DISPLAY PANEL USING THE SAME

(71) Applicant: Samsung Display Co., Ltd., Yongin, Gyeonggi-do (KR)

(72) Inventors: Ki-Hyun Pyun, Goyang-si (KR); Jang-Hoon Kwak, Cheonan-si (KR); Jung-Hoon Ku, Asan-si (KR); Jin-Ki Kim, Chungcheongbuk-do (KR); Seung-Woon Shin, Asan-si (KR); Jun-Ho Hwang, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 83 days.

(21) Appl. No.: 13/940,444

(22) Filed: Jul. 12, 2013

(65) Prior Publication Data

US 2014/0253418 A1 Sep. 11, 2014

(30) Foreign Application Priority Data

Mar. 5, 2013 (KR) ..... 10-2013-0023112

(51) Int. Cl.
*G09G 3/36* (2006.01)

(52) U.S. Cl.
CPC ..... *G09G 3/3696* (2013.01); *G09G 3/3677* (2013.01); *G09G 2330/12* (2013.01)

(58) Field of Classification Search
CPC ..... G09G 2310/0278; G09G 3/36; G09G 3/3696; G09G 3/3674; G09G 3/3611; H03K 17/00
USPC ..... 345/52, 53, 94, 98, 99, 100, 204, 210
See application file for complete search history.

(56) References Cited

U.S. PATENT DOCUMENTS

| | | | | |
|---|---|---|---|---|
| 7,038,653 | B2 | 5/2006 | Moon | |
| 2007/0001991 | A1* | 1/2007 | Jang et al. | 345/100 |
| 2007/0018940 | A1* | 1/2007 | Park | 345/100 |
| 2007/0115244 | A1* | 5/2007 | Shin et al. | 345/100 |
| 2010/0053138 | A1* | 3/2010 | Im et al. | 345/211 |
| 2010/0156869 | A1* | 6/2010 | Lee et al. | 345/208 |
| 2010/0220079 | A1* | 9/2010 | Bang et al. | 345/204 |
| 2011/0285697 | A1* | 11/2011 | Lee et al. | 345/419 |

FOREIGN PATENT DOCUMENTS

| | | |
|---|---|---|
| JP | 08-033321 | 2/1996 |
| JP | 2008-020648 | 1/2008 |
| KR | 1020060133710 | 12/2006 |
| KR | 1020070039759 | 4/2007 |

* cited by examiner

*Primary Examiner* — Premal Patel
(74) *Attorney, Agent, or Firm* — F. Chau & Associates, LLC

(57) ABSTRACT

A gate driving module includes a gate driver and a gate signal generator. The gate driver generates a vertical start signal, a plurality of gate clock signals and a plurality of inverse gate clock signals based on a vertical start control signal, a plurality of gate clock control signals, a gate on voltage, a first gate off voltage and a second gate off voltage. The number of the gate clock signals is P. The number of the inverse gate clock signals is P. The number of the gate clock control signals is P. P is a positive integer equal to or greater than two. The gate signal generator generates a gate signal based on the vertical start signal, the gate clock signals and the inverse gate clock signals.

25 Claims, 9 Drawing Sheets

GATE DRIVING MODULE, DISPLAY APPARATUS HAVING THE SAME AND METHOD OF DRIVING DISPLAY PANEL USING THE SAME

CROSS REFERENCE TO RELATED APPLICATION

This application claims priority under 35 U.S.C. §119 to Korean Patent Application No. 10-2013-0023112, filed on Mar. 5, 2013 in the Korean Intellectual Property Office KIPO, the disclosure of which is incorporated by reference in its entirety herein.

BACKGROUND

1. Technical Field

Exemplary embodiments of the present invention relate to a gate driving module, a display apparatus having the gate driving module and a method of driving a display panel using the gate driving module.

2. Discussion of Related Art

A liquid crystal display ("LCD") apparatus may include a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, a transmittance of a light passing through the liquid crystal layer is adjusted so that a desired image is displayed.

A display apparatus may include a display panel and a panel driver. The display panel includes a plurality of gate lines and a plurality of data lines. The panel driver includes a gate driver providing gate signals to the gate lines and a data driver providing data voltages to the data lines.

When the gate signals having different timings are generated, levels of the gate signals may vary so that gate signals having a uniform level are not transmitted to the display panel. Thus, a display quality of the display panel may deteriorate.

SUMMARY

At least one exemplary embodiment of the present invention provides a gate driving module to aid in generating gate signals having a more uniform level, which may improve a display quality of a display apparatus.

At least one exemplary embodiment of the present invention provides a display apparatus having the gate driving module.

At least one exemplary embodiment of the present invention provides a method of driving a display panel using the gate driving module.

According to an exemplary embodiment of the invention, a gate driving module includes a gate driver and a gate signal generator. The gate driver generates a vertical start signal, a plurality of gate clock signals and a plurality of inverse gate clock signals based on a vertical start control signal, a plurality of gate clock control signals, a gate on voltage, a first gate off voltage and a second gate off voltage. The number of the gate clock signals is P. The number of the inverse gate clock signals is P. The number of the gate clock control signals is P. P is a positive integer equal to or greater than two. The gate signal generator generates a gate signal based on the vertical start signal, the gate clock signals and the inverse gate clock signals.

In an exemplary embodiment, each gate clock signal has the gate on voltage during a high level duration, the first gate off voltage during a first low level duration and a compensated voltage which is less than the first gate off voltage and equal to or greater than the second gate off voltage during a second low level duration.

In an exemplary embodiment, each gate clock signal has the compensated voltage during the second low level duration when the vertical start control signal has a high level and a corresponding one of the gate clock control signals has a low level.

In an exemplary embodiment, the gate driver include a gate controller, a first amplifier connected to the gate controller, first and second transistors connected to the first amplifier and outputting the gate clock signal, a second amplifier connected to the gate controller, a third transistor connected to the second amplifier, a third amplifier connected to the gate controller, and fourth and fifth transistors connected to the third amplifier and outputting the inverse gate clock signals.

In an exemplary embodiment, the gate driver further includes a fourth amplifier, a sixth transistor connected to the fourth amplifier and the first and second transistors and a fourth amplifier controller connected to the gate controller and the fourth amplifier, and controlling an operation of the fourth amplifier.

In an exemplary embodiment, the fourth amplifier controller includes an RS latch including a set terminal to which the vertical start control signal is applied and a reset terminal to which the gate clock control signals are applied.

In an exemplary embodiment, the fourth amplifier controller includes a NAND gate to which the vertical start control signal and the gate clock control signals are applied.

In an exemplary embodiment, the gate signal generator includes a plurality of stages connected to each other. Each stage may output the gate signal and a carry signal based on a corresponding one of the gate clock signals, the first gate off voltage and the second gate off voltage.

In an exemplary embodiment, an n-th stage among the stages may include a buffer part applying a carry signal from a previous stage to a first node in response to the carry signal, a pull-up part outputting the one gate clock signal as an n-th gate signal in response to a signal applied to the first node, a carry part outputting the one gate clock signal as an n-th carry signal in response to the signal applied to the first node and a pull-down part pulling down the n-th gate signal in response to a carry signal from a next stage, and n is a positive integer.

In an exemplary embodiment, when p is 3, a first gate clock signal may be applied to a first stage, a second gate clock signal may be applied to a second stage adjacent to the first stage, a third gate clock signal may be applied to a third stage adjacent to the second stage, a first inverse gate clock signal which is inverted from the first gate clock signal may be applied to a fourth stage adjacent to the third stage, a second inverse gate clock signal which is inverted from the second gate clock signal may be applied to a fifth stage adjacent to the fourth stage and a third inverse gate clock signal which is inverted from the third gate clock signal may be applied to a sixth stage adjacent to the fifth stage.

In an exemplary embodiment, a first carry signal of the first stage is applied to the fourth stage, a second carry signal of the second stage is applied to the fifth stage and a third carry signal of the third stage is applied to the sixth stage.

According to an exemplary embodiment of the invention, a display apparatus includes a display panel, a gate driving module and a data driver. The display panel displays an image. The gate driving module includes a gate driver and a gate signal generator. The gate driver generates a vertical start signal, a plurality of gate clock signals and a plurality of inverse gate clock signals based on a vertical start control signal, a plurality of gate clock control signals, a gate on voltage, a first gate off voltage and a second gate off voltage. The number of the gate clock signals is P. The number of the inverse gate clock signals is P. The number of the gate clock control signals is P. P is a positive integer equal to or greater than two. The gate signal generator generates a gate signal based on the vertical start signal, the gate clock signals and the inverse gate clock signals. The gate signal generator outputs the gate signal to the display panel. The data driver generates a data voltage and outputting the data voltage to the display panel.

In an exemplary embodiment, each gate clock signal has the gate on voltage during a high level duration, the first gate off voltage during a first low level duration and a compensated voltage which is less than the first gate off voltage and equal to or greater than the second gate off voltage during a second low level duration.

In an exemplary embodiment, each gate clock signal has the compensated voltage during the second low level duration when the vertical start control signal has a high level and a corresponding one of the gate clock control signals has a low level.

In an exemplary embodiment, the gate driver includes a gate controller, a first amplifier connected to the gate controller, first and second transistors connected to the first amplifier and outputting the gate clock signal, a second amplifier connected to the gate controller, a third transistor connected to the second amplifier, a third amplifier connected to the gate controller, and fourth and fifth transistors connected to the third amplifier and outputting the inverse gate clock signal.

In an exemplary embodiment, the gate driver further includes a fourth amplifier, a sixth transistor connected to the fourth amplifier and the first and second transistors and an amplifier controller connected to the gate controller and the fourth amplifier, and controlling an operation of the fourth amplifier.

In an exemplary embodiment, the gate signal generator may be integrated on the display panel.

According to an exemplary embodiment of the invention, a method of driving a display panel includes generating a vertical start signal, a plurality of gate clock signals and a plurality of inverse gate clock signals based on a vertical start control signal, a plurality of gate clock control signals, a gate on voltage, a first gate off voltage and a second gate off voltage and generating a gate signal based on the vertical start signal, the gate clock signals and the inverse gate clock signals. The number of the gate clock signals is P. The number of the inverse gate clock signals is P. The number of the gate clock control signals is P. P is a positive integer equal to or greater than two.

In an exemplary embodiment, each gate clock signal has the gate on voltage during a high level duration, the first gate off voltage during a first low level duration and a compensated voltage which is less than the first gate off voltage and equal to or greater than the second gate off voltage during a second low level duration.

In an exemplary embodiment, each gate clock signal has the compensated voltage during the second low level duration when the vertical start control signal has a high level and a corresponding one of the gate clock control signals has a low level.

According to an exemplary embodiment of the invention, a gate driving module includes a gate controller configured to output a vertical start control signal and a plurality of gate clock control signals, a first amplifier configured to receive the gate clock control signals as input, first and second transistors connected to the first amplifier and configured to output gate clock signals, a second amplifier configured to receive the gate clock control signals as input, a third transistor connected to the second amplifier, a third amplifier configured to receive the gate clock control signals as input, fourth and fifth transistors connected to the third amplifier and configured to output inverse gate clock signals, a fourth amplifier, a sixth transistor connected to the fourth amplifier and the first and second transistors. Each of the gate clock control signals have a low level during a period the vertical start control signal has a high level, and durations of the low levels all differ from one another.

In an exemplary embodiment, the first transistor is connected to a gate on voltage, the second transistor is connected to a first gate off voltage, the sixth transistor is connected to a second gate off voltage, the fourth transistor is connected to the gate on voltage, and the fifth transistor is connected to first gate off voltage. In an exemplary embodiment, the gate on voltage is higher than the gate off voltages and the second gate off voltage is lower than the first gate off voltage. In an exemplary embodiment, the gate driving module includes a first resistor connecting the third transistor to a node connected to both the first and second transistors, and a second transistor connecting the sixth transistor to the same node. In an exemplary embodiment, the gate driving module includes an amplifier controller configured to receive the gate clock control signals and the vertical start control signal as inputs and provide an output to the fourth amplifier.

BRIEF DESCRIPTION OF THE DRAWINGS

The present invention will become more apparent by describing in detail exemplary embodiments thereof with reference to the accompanying drawings, in which.

DETAILED DESCRIPTION

Hereinafter, exemplary embodiments of the present invention will be explained in detail with reference to the accompanying drawings.

Figure 1:
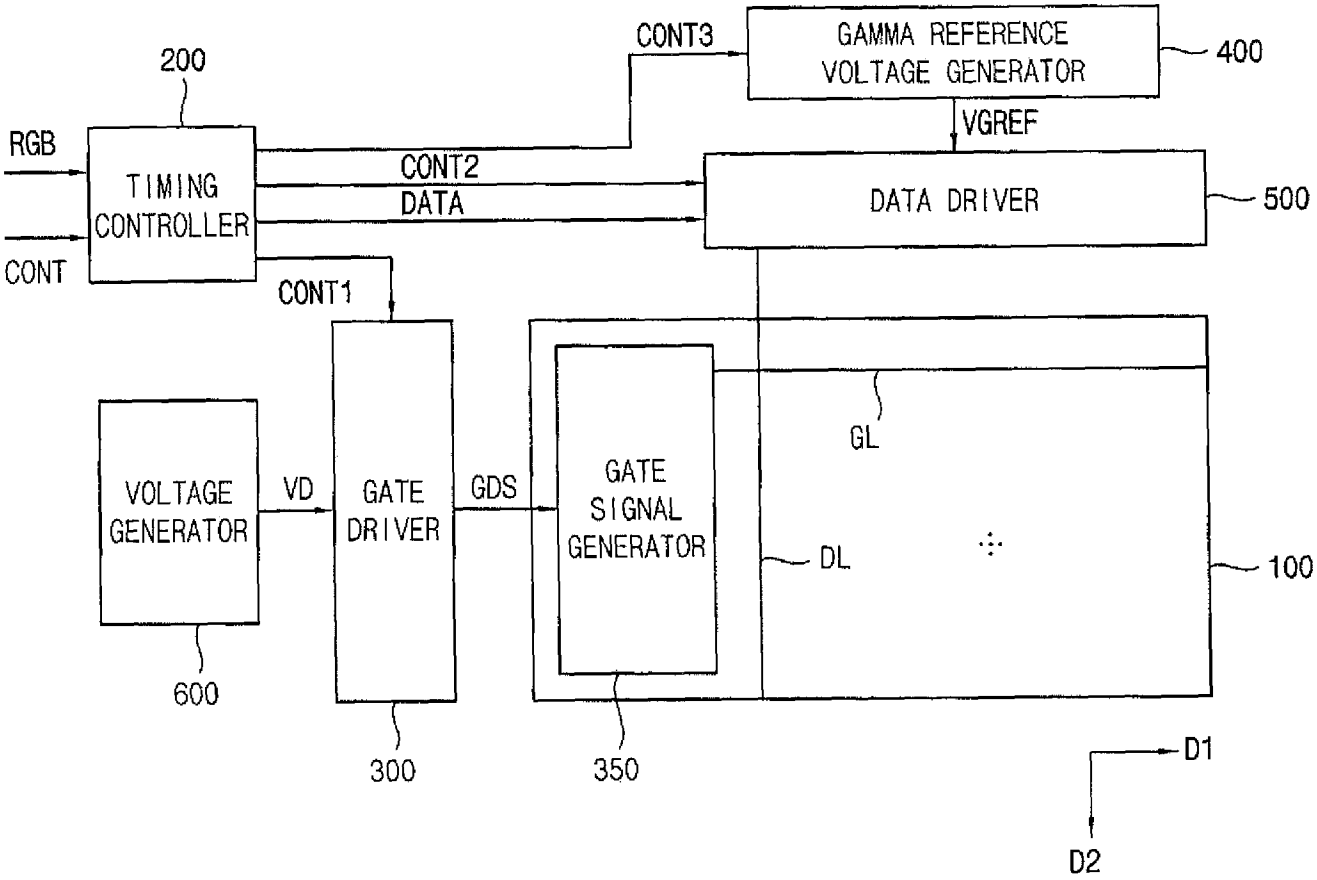
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, the display apparatus includes a display panel 100, a timing controller 200, a gate driver 300, a gate signal generator 350, a gamma reference voltage generator 400, a data driver 500 and a voltage generator 600.

The display panel 100 has a display region on which an image is displayed and a peripheral region adjacent to the display region.

The display panel 100 includes a plurality of gate lines GL, a plurality of data lines DL and a plurality of unit pixels connected to the gate lines GL and the data lines DL. The gate lines GL extend in a first direction D1 and the data lines DL extend in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels may be disposed in a matrix form.

The timing controller 200 receives input image data RGB and an input control signal CONT from an external apparatus (not shown). The input image data may include red image data R, green image data G and blue image data B. The input control signal CONT may include a master clock signal and a data enable signal. The input control signal CONT may include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start control signal and a gate clock control signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates a gate driving signal GDS in response to the first control signal CONT1 received from the timing controller 200 and a driving voltage VD received from the voltage generator 600.

For example, the gate driver 300 may be directly mounted on the display panel 100, or may be connected to the display panel 100 as a tape carrier package ("TCP") type.

A structure of the gate driver 300 according to an exemplary embodiment of the invention is explained with reference to FIGS. 2 to 4.

The gate signal generator 350 generates gate signals to drive the gate lines GL in response to the gate driving signal GDS received from the gate driver 300. The gate signal generator 350 sequentially outputs the gate signals to the gate lines GL.

For example, the gate signal generator 350 may be an amorphous silicon gate ("ASG") driver circuit, which is integrated on the peripheral region of the display panel 100.

A structure of the gate signal generator 350 according to an exemplary embodiment of the invention is explained with reference to FIGS. 5 and 6.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 is disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 sequentially outputs the data voltages to the data lines DL.

The data driver 500 may include a shift register (not shown), a latch (not shown), a signal processing part (not shown) and a buffer part (not shown). The shift register outputs a latch pulse to the latch. The latch temporally stores the data signal DATA. The latch outputs the data signal DATA to the signal processing part. The signal processing part generates a data voltage having an analog type based on the data signal having a digital type and the gamma reference voltage VGREF. The signal processing part outputs the data voltage to the buffer part. The buffer part compensates the data voltage to have a uniform level. The buffer part outputs the compensated data voltage to the data line DL.

The data driver 500 may be directly mounted on the display panel 100, or be connected to the display panel 100 in a TCP type. Alternatively, the data driver 500 may be integrated on the display panel 100.

The voltage generator 600 generates the driving voltage VD used to generate the gate signal and outputs the driving voltage VD to the gate driver 300.

The driving voltage VD may include a gate on voltage VON, a first gate off voltage VOFF1 and a second gate off voltage VOFF2.

Figure 2:
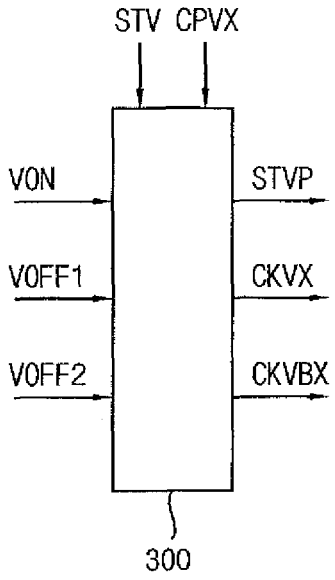
FIG. 2 is a block diagram illustrating input signals and output signals of a gate driver of FIG. 1 according to an exemplary embodiment of the invention.

FIG. 2 is a block diagram illustrating input signals and output signals of the gate driver 300 of FIG. 1 according to an exemplary embodiment of the invention.

Referring to FIGS. 1 and 2, the gate driver 300 receives the vertical start control signal STV and a plurality of the gate clock control signals CPVX from the timing controller 200.

For example, the gate driver 300 may receive three gate clock control signals CPVX in an exemplary embodiment of the invention.

The gate driver 300 receives the gate on voltage VON, the first gate off voltage VOFF1 and the second gate off voltage VOFF2 from the voltage generator 600.

The gate driver 300 generates a vertical start signal STVP, a plurality of gate clock signals CKVX and a plurality of inverse gate clock signal CKVBX based on the vertical start control signal STY, the gate clock control signals CPVX, the gate on voltage VON, the first gate off voltage VOFF1 and the second gate off voltage VOFF2.

The vertical start signal STVP is generated based on the vertical start control signal STV. The gate clock signals CKVX and the inverse gate clock signals CKVBX are generated based on the gate clock control signals CPVX. The inverse gate clock signals CKVBX may be a signal inverted from the gate clock signals CKVX.

For example, the gate driver 300 may generate three gate clock signals CKVX and three inverse gate clock signals CKVBX based on the three gate clock control signals CPVX in an exemplary embodiment of the invention.

The gate driver 300 outputs the vertical start signal STVP, the gate clock signals CKVX and the inverse gate clock signals CKVBX to the gate signal generator 350.

Figure 3:
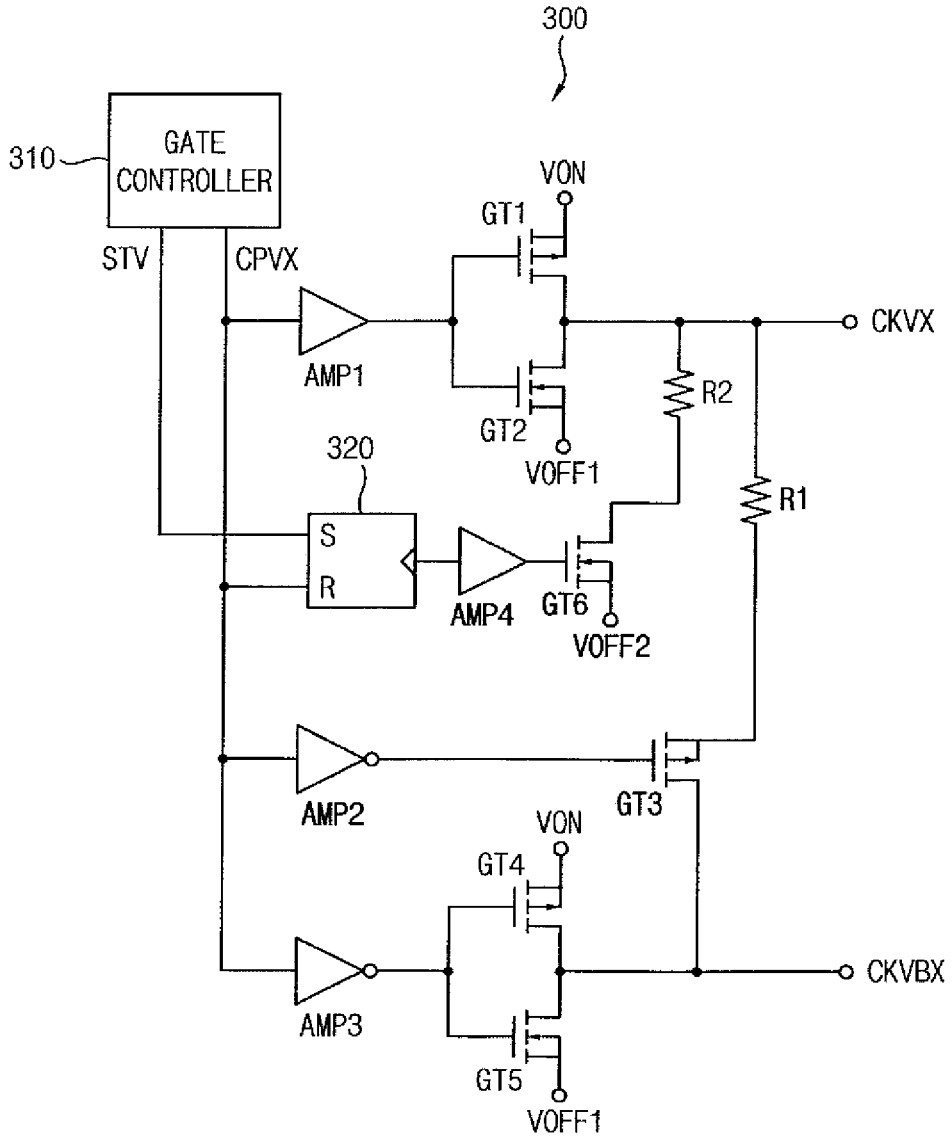
FIG. 3 is a block diagram illustrating the gate driver of FIG. 1 according to an exemplary embodiment of the invention.

FIG. 3 is a block diagram illustrating the gate driver 300 of FIG. 1 according to an exemplary embodiment of the invention. FIG. 4 is a waveform diagram illustrating the input signals and the output signals of the gate driver 300 of FIG. 1 according to an exemplary embodiment of the invention.

In FIG. 3 illustrates a first part of the gate driver 300 for generating the gate clock signals CKVX and the inverse gate clock signals CKVBX. While the gate driver 300 may include a second part for generating the vertical start signal STVP, this second part is not shown for convenience of explanation.

Referring to FIGS. 1 to 4, the gate driver 300 includes a gate controller 310, a first amplifier AMP1, a second amplifier AMP2, a third amplifier AMP3, a first transistor GT1, a second transistor GT2, a third transistor GT3, a fourth transistor GT4 and a fifth transistor GT5.

The gate driver 300 may further include a fourth amplifier AMP4, a sixth transistor GT6 and a fourth amplifier controller 320.

The gate controller 310 outputs the vertical start control signal STV and the gate clock control signal CPVX to the first to fourth amplifiers AMP1 to AMP4.

Specifically, the gate controller 310 outputs the vertical start control signal STY to the fourth amplifier controller 320 disposed adjacent to the fourth amplifier AMP4. The gate controller 310 outputs the gate clock control signal CPVX to the first to third amplifiers AMP1 to AMP3 and the fourth amplifier controller 320.

The first amplifier AMP1 receives the gate clock control signal CPVX from the gate controller 310. The first amplifier AMP1 amplifies the gate clock control signal CPVX and outputs the amplified gate clock control signal CPVX to the first and second transistors GT1 and GT2. For example, the first amplifier AMP1 may be a non-inverting amplifier.

The first and second transistors GT1 and GT2 are connected to the first amplifier AMP1 and output the gate clock signal CKVX.

The first transistor GT1 may be a P-type MOSFET (Metal-Oxide-Semiconductor Field Effect Transistor). The second transistor GT2 may be an N-type MOSFET.

A gate electrode of the first transistor GT1 is connected to an output terminal of the first amplifier AMP1. The gate on voltage VON is applied to a source electrode of the first transistor GT1. A drain electrode of the first transistor GT1 is connected to a drain electrode of the second transistor GT2 and outputs the gate clock signal CKVX.

A gate electrode of the second transistor GT2 is connected to the output terminal of the first amplifier AMP1. The first gate off voltage VOFF1 is applied to a source electrode of the second transistor GT2. The drain electrode of the second transistor GT2 is connected to the drain electrode of the first transistor GT1 and outputs the gate clock signal CKVX.

The second amplifier AMP2 receives the gate clock control signal CPVX from the gate controller 310. The second amplifier AMP2 amplifies the gate clock control signal CPVX and outputs the amplified gate clock control signal CPVX to the third transistor GT3. For example, the second amplifier AMP2 may be an inverting amplifier.

The third transistor GT3 may be the P-type MOSFET. A gate electrode of the third transistor GT3 is connected to an output terminal of the second amplifier AMP2. A source electrode of the third transistor GT3 is connected to a first end of a first resistor R1. A drain electrode of the third transistor GT3 is connected to a terminal outputting the inverse gate clock signal CKVBX. A second end of the first resistor R1 is connected to a terminal outputting the gate clock signal CKVX.

The third amplifier AMP3 receives the gate clock control signal CPVX from the gate controller 310. The third amplifier AMP3 amplifies the gate clock control signal CPVX and outputs the amplified gate clock control signal CPVX to the fourth and fifth transistors GT4 and GT5. For example, the third amplifier AMP3 may be the inverting amplifier.

The fourth and fifth transistors GT4 and GT5 are connected to the third amplifier AMP3 and output the inverse gate clock signal CKVBX.

The fourth transistor GT4 may be the P-type MOSFET. The fifth transistor GT5 may be the N-type MOSFET.

A gate electrode of the fourth transistor GT4 is connected to an output terminal of the third amplifier AMP3. The gate on voltage VON is applied to a source electrode of the fourth transistor GT4. A drain electrode of the fourth transistor GT4 is connected to a drain electrode of the fifth transistor GT5 and outputs the inverse gate clock signal CKVBX.

A gate electrode of the fifth transistor GT5 is connected to the output terminal of the third amplifier AMP3. The first gate off voltage VOFF1 is applied to a source electrode of the fifth transistor GT5. The drain electrode of the fifth transistor GT5 is connected to the drain electrode of the fourth transistor GT4 and outputs the inverse gate clock signal CKVBX.

The fourth amplifier controller 320 receives the vertical start control signal STV and the gate clock control signal CPVX from the gate controller 310.

The fourth amplifier controller 320 is connected to the gate controller 310 and the fourth amplifier AMP4 and controls an operation of the fourth amplifier AMP4.

In an exemplary embodiment, the fourth amplifier controller 320 is an RS latch. The fourth amplifier controller 320 includes a set terminal S to which the vertical start control signal STV is applied and a reset terminal R to which the gate clock control signal CPVX is applied.

When the vertical start control signal STV has a high level, the fourth amplifier controller 320 has a set status so that the fourth amplifier controller 320 outputs a high level signal. When the gate clock control signal CPVX has a high level, the fourth amplifier controller 320 has a reset status so that the fourth amplifier controller 320 outputs a low level signal.

The fourth amplifier AMP4 receives an amplifier control signal from the fourth amplifier controller 320. The fourth amplifier AMP4 amplifies the amplifier control signal and outputs the amplified amplifier control signal to the sixth transistor GT6. For example, the fourth amplifier AMP4 may be the non-inverting amplifier.

The sixth transistor GT6 may be the N-type MOSFET. A gate electrode of the sixth transistor GT6 is connected to an output terminal of the fourth amplifier AMP4. The second gate off voltage VOFF2 is applied to a source electrode of the sixth transistor GT6. A drain electrode of the sixth transistor GT6 is connected to a first end of a second resistor R2. A second end of the second resistor R2 is connected to the terminal outputting the gate clock signal CKVX.

The second resistor R2 may be a variable resistor. Examples of a variable resistor include a potentiometer, a rheostat, etc. The second resistor R2 may enable or disable the sixth transistor GT6 according to its variable resistance. For example, if the resistance of the second resistor R2 is set very large, little or no current will flow from the sixth transistor GT6 to the node commonly connected to the first and second transistors GT1 and GT2.

Figure 4:
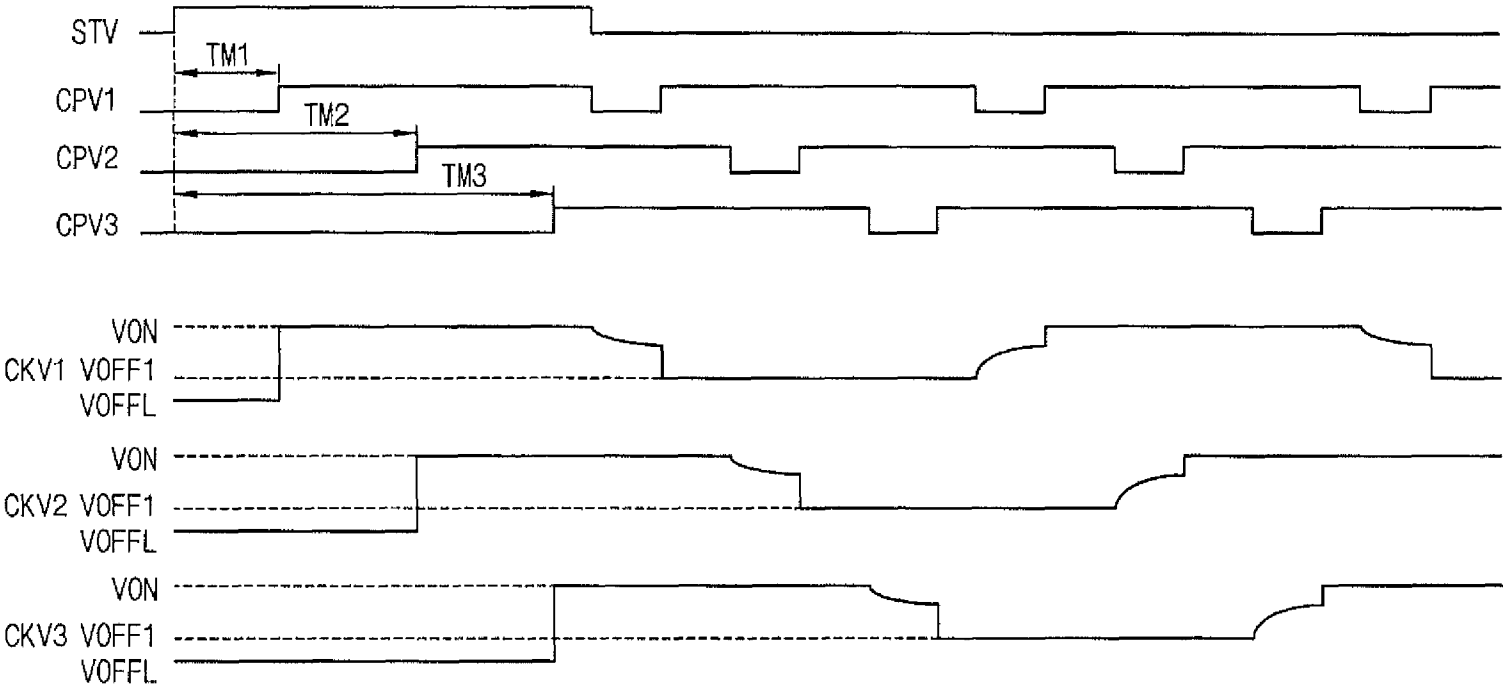
FIG. 4 is a waveform diagram illustrating the input signals and the output signals of the gate driver of FIG. 1 according to an exemplary embodiment of the invention.

FIG. 4 illustrates a first gate clock control signal CPV1, a second gate clock control signal CPV2 and a third gate clock control signal CPV3 have different timings.

In addition, overlapped durations of high-durations of the first to third gate clock control signals CPV1 to CPV3 with a high-duration of the vertical start control signal STV are different from each other.

When the first gate clock signal CKV1 generated based on the first gate clock control signal CPV1 is applied to a first gate line of the display panel 100, the second gate clock signal CKV2 generated based on the second gate clock control signal CPV2 is applied to a second gate line of the display panel 100, the third gate clock signal CKV3 generated based on the third gate clock control signal CPV3 is applied to a third gate line of the display panel 100, the overlapped duration of the high-duration of the first gate clock signal CKV1 with a high-duration of the vertical start signal STVP is relatively long so that a gate signal applied to the first gate line is relatively great. However, the overlapped duration of the high-duration of the second gate clock signal CKV2 with the high-duration of the vertical start control signal STVP is shorter than the overlapped duration of the high-duration of the first gate clock signal CKV1 with the high-duration of the vertical start signal STVP so that a gate signal applied to the second gate line is less than the gate signal applied to the first gate line. Furthermore, the overlapped duration of the high-duration of the third gate clock signal CKV3 with the high-duration of the vertical start control signal STVP is shorter than the overlapped duration of the high-duration of the first gate clock signal CKV1 with the high-duration of the vertical start signal STVP and the overlapped duration of the high-duration of the second gate clock signal CKV2 with the high-duration of the vertical start signal STVP so that a gate signal applied to the third gate line is less than the gate signal applied to the first gate line and the gate signal applied to the second gate line.

In an exemplary embodiment, the gate clock signals CKV1, CKV2 and CKV3 have a high level corresponding to the gate on voltage VON during a high level duration, a first low level corresponding to the first gate off voltage VOFF1 during a first low level duration and a second low level corresponding to a compensated voltage VOFFL which is less than the first gate off voltage VOFF1 and is equal to or greater than the second gate off voltage VOFF2 during a second low level duration.

The gate clock signals CKV1, CKV2 and CKV3 have the second low level when the vertical start control signal STY has a high level and a corresponding one of the gate clock control signals CPV1, CPV2 and CPV3 has a low level.

For example, the first gate clock signal CKV1 has the compensated voltage VOFFL when the vertical start control signal STV has the high level and the first gate clock control signal CPV1 has the low level (e.g., during period TM1).

For example, the second gate clock signal CKV2 has the compensated voltage VOFFL when the vertical start control signal STV has the high level and the second gate clock control signal CPV2 has the low level (e.g., during period TM2).

For example, the third gate clock signal CKV3 has the compensated voltage VOFFL when the vertical start control signal STY has the high level and the third gate clock control signal CPV3 has the low level (e.g., during period TM3).

Thus, electric potential difference of the first gate signal, electric potential difference of the second gate signal and electric potential difference of the third gate signal increase. Therefore, a difference among an amplitude of the first gate signal, an amplitude of the second gate signal and an amplitude of the third gate signal may decrease. As a result, the gate signals according to the gate lines may become generally uniform.

The second low level duration of the second gate clock signal CKV2 in which the second gate clock signal CKV2 has the compensated voltage VOFFL is longer than the second low level duration of the first gate clock signal CKV1 in which the first gate clock signal CKV1 has the compensated voltage VOFFL so that an increase of the electric potential difference of the second gate signal is greater than an increase of the electric potential difference of the first gate signal. Thus, a difference of the amplitudes of the gate signals may be further reduced.

In an exemplary embodiment of the invention, the compensated voltage VOFFL is not applied to the first gate clock signal CKV1 and the compensated voltage VOFFL is applied only to the second and third gate clock signals CKV2 and CKV3 corresponding to the second and third gate signals which have levels lower than the first gate signal.

The gate on voltage VON may be a direct-current ("DC") voltage. For example, the gate on voltage VON may be between about 15V and about 20V.

The first gate off voltage VOFF1 may be the DC voltage. The second gate off voltage VOFF2 may be the DC voltage. The second gate off voltage VOFF2 may be less than the first gate off voltage VOFF1. For example, the first gate off voltage VOFF1 may be about −7V. For example, the second gate off voltage VOFF2 may be about −12V. For example, the compensated voltage VOFFL may be an average value of the first gate off voltage VOFF1 and the second gate off voltage VOFF2. The second gate off voltage VOFF2 may be properly adjusted to minimize the difference of the amplitudes of the gate signals by the compensated voltage VOFFL.

Hereinafter, an exemplary operation of the gate driver 300 is explained with reference to FIGS. 3 and 4.

When the gate clock control signal CPVX has a high level, the first transistor GT1 is turned on and the second transistor GT2 is turned off so that the gate driver 300 outputs the gate clock signal CKVX having the gate on voltage VON level.

When the gate clock control signal CPVX has a low level, the second transistor GT2 is turned on and the first transistor GT1 is turned off so that the gate driver 300 outputs the gate clock signal CKVX having the first gate off voltage VOFF1 level.

When the vertical start control signal STV has a high level and the gate clock control signal CPVX has a low level, the second transistor GT2 and the sixth transistor GT6 are turned on and the first transistor GT1 is turned off so that the gate driver 300 outputs the gate clock signal CKVX having the compensated voltage VOFFL which is between the first gate off voltage VOFF1 and the second gate off voltage VOFF2.

Figure 5:
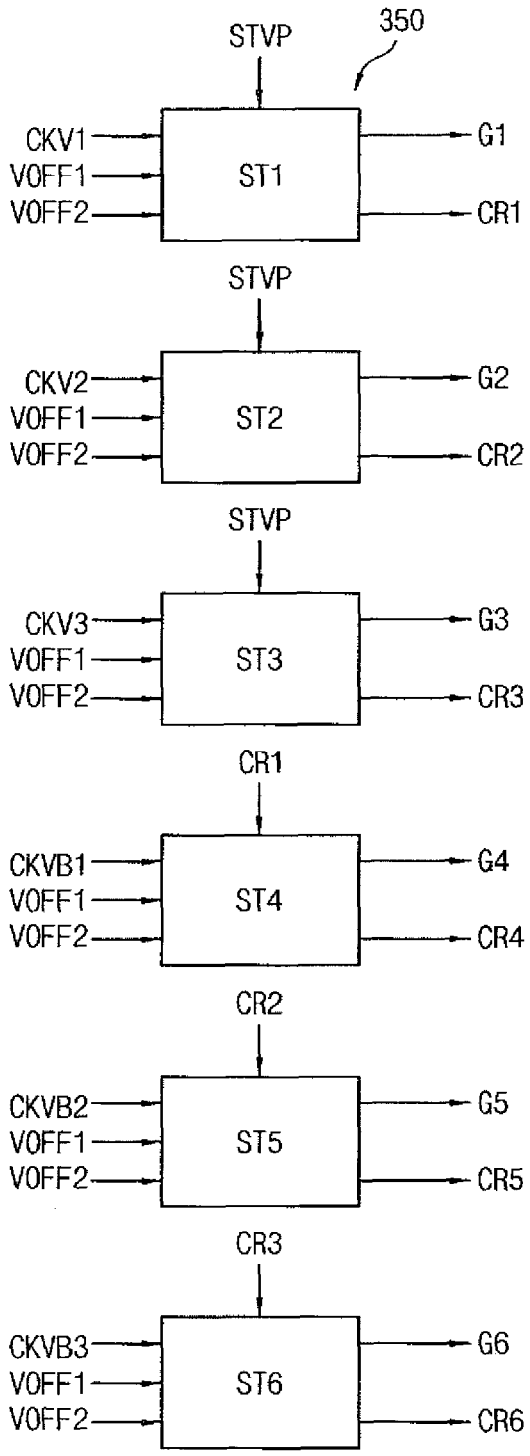
FIG. 5 is a block diagram illustrating a gate signal generator of FIG. 1 according to an exemplary embodiment of the invention.

FIG. 5 is a block diagram illustrating the gate signal generator 350 of FIG. 1 according to an exemplary embodiment of the invention.

Referring to FIGS. 1 to 5, the gate signal generator 350 includes a plurality of stages connected to each other.

In an exemplary embodiment, the gate signal generator 350 receives the first gate off voltage VOFF1 and the second gate off voltage VOFF2 from the voltage generator 600.

The stages output the gate signals G1 to G6 and carry signals CR1 to CR6 based on the gate clock signals CKV1 to CKV3 or the inverse gate clock signals CKVB1 to CKVB3, the first gate off voltage VOFF1 and the second gate off voltage VOFF2.

A first stage ST1 generates a first gate signal G1 for driving a first gate line of the display panel 100 and a first carry signal CR1 based on the first gate clock signal CKV1, the vertical start signal STVP, the first gate off voltage VOFF1 and the second gate off voltage VOFF2. The first gate signal G1 is outputted to the first gate line. The first carry signal CR1 may be outputted to a fourth stage ST4.

A second stage ST2 adjacent to the first stage ST1 generates a second gate signal G2 for driving a second gate line of the display panel 100 and a second carry signal CR2 based on the second gate clock signal CKV2, the vertical start signal STVP, the first gate off voltage VOFF1 and the second gate off voltage VOFF2. The second gate signal G2 is outputted to the second gate line. The second carry signal CR2 may be outputted to a fifth stage ST5.

A third stage ST3 adjacent to the second stage ST2 generates a third gate signal G3 for driving a third gate line of the display panel 100 and a third carry signal CR3 based on the third gate clock signal CKV3, the vertical start signal STVP, the first gate off voltage VOFF1 and the second gate off voltage VOFF2. The third gate signal G3 is outputted to the third gate line. The third carry signal CR3 may be outputted to a sixth stage ST6.

The fourth stage ST4 adjacent to the third stage ST3 generates a fourth gate signal G4 for driving a fourth gate line of the display panel 100 and a fourth carry signal CR4 based on a first inverse gate clock signal CKVB1, the first carry signal CR1, the first gate off voltage VOFF1 and the second gate off voltage VOFF2. The fourth gate signal G4 is outputted to the fourth gate line. Although not shown in the figures, the fourth carry signal CR4 may be outputted to a seventh stage ST7.

The fifth stage ST5 adjacent to the fourth stage ST4 generates a fifth gate signal G5 for driving a fifth gate line of the display panel 100 and a fifth carry signal CR5 based on a second inverse gate clock signal CKVB2, the second carry signal CR2, the first gate off voltage VOFF1 and the second gate off voltage VOFF2. The fifth gate signal G5 is outputted to the fifth gate line. Although not shown in figures, the fifth carry signal CR5 may be outputted to an eighth stage ST8.

The sixth stage ST6 adjacent to the fifth stage ST5 generates a sixth gate signal G6 for driving a sixth gate line of the display panel 100 and a sixth carry signal CR6 based on a third inverse gate clock signal CKVB3, the third carry signal CR3, the first gate off voltage VOFF1 and the second gate off voltage VOFF2. The sixth gate signal G6 is outputted to the sixth gate line. Although not shown in figures, the sixth carry signal CR6 may be outputted to a ninth stage. ST9.

The seventh stage ST7 and stages after the seventh stage ST7 are not shown in the figures. The seventh stage ST7 and stages after the seventh stage ST7 are connected to each other in the same way as the prior stages explained above.

Although the gate signal generator 350 generates three gate clock signals CKV1 to CKV3 based on three gate clock control signals CPV1 to CPV3 in an exemplary embodiment, the present invention is not limited thereto. The gate signal generator 350 may generate a plurality of gate clock signals CKVX based on a plurality of gate clock control signals CPVX.

Figure 6:
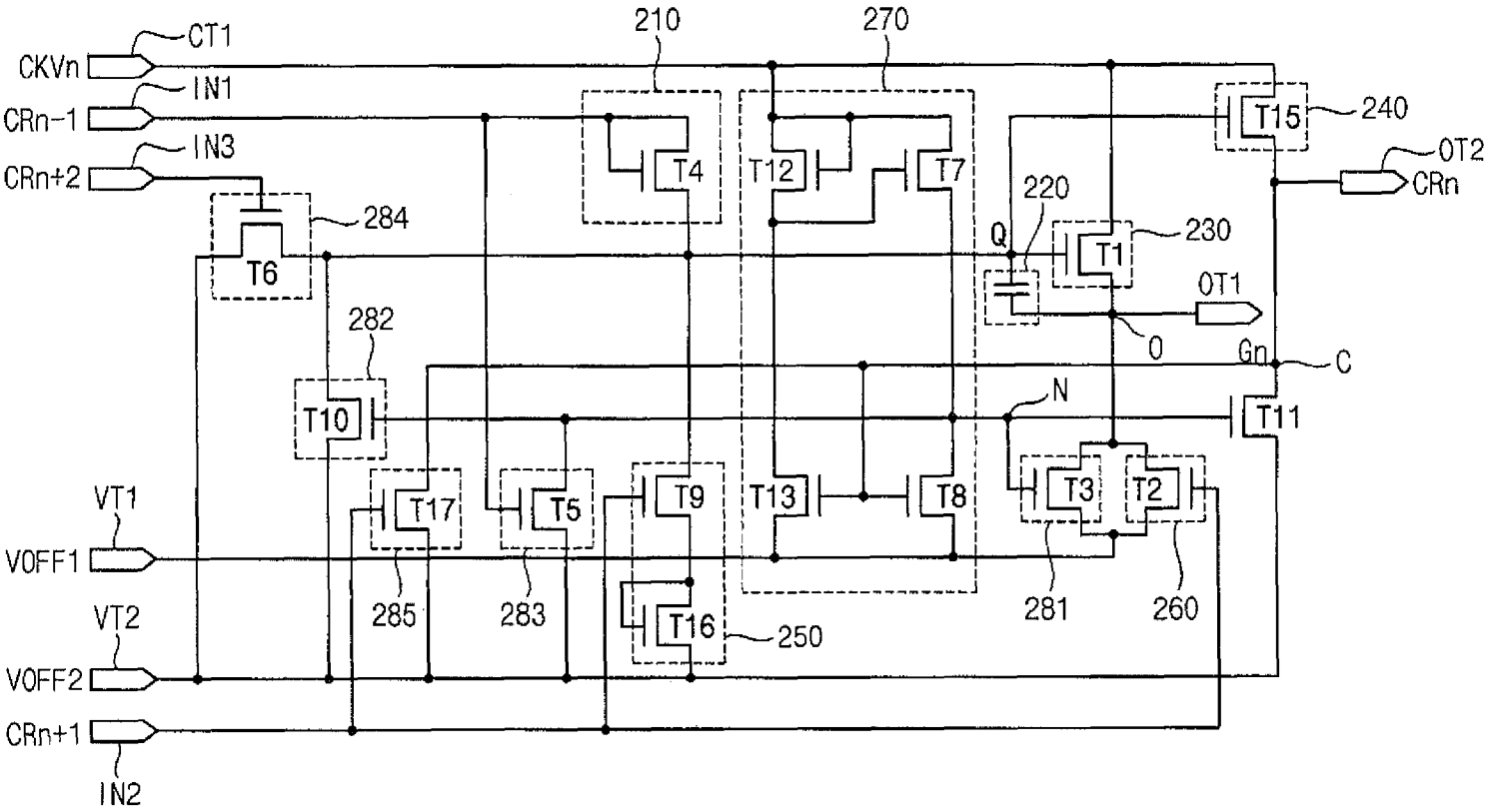
FIG. 6 is an equivalent circuit diagram illustrating an N-th stage of the gate signal generator of FIG. 1 according to an exemplary embodiment of the invention.

FIG. 6 is an equivalent circuit diagram illustrating an N-th stage of the gate signal generator 350 of FIG. 1 according to an exemplary embodiment of the invention.

Referring to FIGS. 1 to 6, the n-th stage according to an exemplary embodiment includes a buffer part 210, a charging part 220, a pull-up part 230, a carry part 240, a discharging part 250, a pull-down part 260, a switching part 270 and a first maintaining part 281.

The buffer part 210 includes a fourth ASG transistor T4. A control terminal and an input terminal of the fourth ASG transistor T4 are connected to the first input terminal IN1 receiving the vertical start signal STVP or a carry signal (e.g. CRn−1) of one of the previous stages, and an output terminal of the fourth ASG transistor T4 is connected to internal node Q. The internal node Q is connected to a first end portion of the charging part 220. When a high voltage of the vertical start signal STVP is received at the buffer part 210, the charging part 220 is charged with a first voltage corresponding to the high voltage. In the fourth ASG transistor T4, the control terminal, the input terminal and the output terminal may be a gate electrode, a source electrode and a drain electrode, respectively.

The pull-up part 230 includes a first ASG transistor T1. The first ASG transistor T1 includes a control terminal connected to the internal node Q, an input terminal connected to the first clock terminal CT1 and an output terminal connected to an output node O. The control terminal of the first ASG transistor T1 is connected to a first terminal of the charging part 220, and the output node O is connected to the first output terminal OT1. The first terminal of the charging part 220 is connected to the internal node Q. The control terminal, the input terminal and the output terminal of the first ASG transistor T1 may be a gate electrode, a source electrode and a drain electrode, respectively.

In a state where the first voltage charged in the charging part 220 is applied to the control terminal of the pull-up part 230, and when a high voltage of the gate clock signal CKVn is received at the first clock terminal CT1, the pull-up part 230 is bootstrapped. At this time, the internal node Q connected to the control terminal of the pull-up part 230 is boosted to a boosting voltage at the first voltage.

During a time the boosting voltage is applied to the control terminal of the pull-up part 230, the pull-up part 230 outputs a high voltage of the first clock signal CKn as a high voltage of an n-th gate signal Gn.

The carry part 240 includes a fifteenth ASG transistor T15. The fifteenth ASG transistor T15 includes a control terminal connected to the internal node Q, an input terminal connected to the first clock terminal CT1 and an output terminal connected to a second output terminal OT2. When a high voltage is applied to the internal node Q, the carry part 240 outputs a high voltage of the first clock signal CKn received at the clock terminal CT as an n-th carry signal CRn. The control terminal, the input terminal and the output terminal of the fifteenth ASG transistor T15 may be a gate electrode, a source electrode and a drain electrode, respectively.

The discharging part 250 includes a ninth ASG transistor T9 and a sixteenth ASG transistor T16. The ninth ASG transistor T9 includes a control terminal connected to a second input terminal IN2, an input terminal connected to the internal node Q, and an output terminal connected to the sixteenth ASG transistor T16. The sixteenth ASG transistor T16 includes a control terminal and an input terminal that are commonly connected to the output terminal of the ninth ASG transistor T9, and an output terminal connected to a second voltage terminal VT2. When a carry signal (e.g. CRn+1) of one of the next stages is received at the second input terminal IN2, the discharging part 250 discharges a voltage of the internal node Q into the second gate off voltage VOFF2 applied to the second voltage terminal VT2. The control terminal, the input terminal and the output terminal of the ninth ASG transistor T9 may be a gate electrode, a source electrode and a drain electrode, respectively. The control terminal, the input terminal and the output terminal of the sixteenth ASG transistor T16 may be a gate electrode, a source electrode and a drain electrode, respectively.

The pull-down part 260 includes a second ASG transistor T2. The second ASG transistor T2 includes a control terminal connected to the second input terminal IN2, an input terminal connected to the output node O and an output terminal connected to the first input terminal VT1. When the carry signal (e.g. CRn+1) of one of the next stages is applied to the second input terminal IN2, the pull-down part 260 discharges a voltage of the output node O into the first gate off voltage VOFF1 applied to the first voltage terminal VT1. The control terminal, the input terminal and the output terminal of the second ASG transistor T2 may be a gate electrode, a source electrode and a drain electrode, respectively.

The switching part 270 includes a twelfth ASG transistor T12, a seventh ASG transistor T7, a thirteenth ASG transistor T13 and an eighth ASG transistor T8. A control terminal and an input terminal of the twelfth ASG transistor T12 are connected to the first clock terminal CT1, and an output terminal of the twelfth ASG transistor T12 is connected to an input terminal of the thirteenth ASG transistor T13 and the seventh ASG transistor T7. The seventh ASG transistor T7 includes a control terminal connected to an output terminal of the twelfth ASG transistor T12, an input terminal connected to the first clock terminal CT, and an output terminal connected to an input terminal of the eighth ASG transistor T8. An output terminal of the seventh ASG transistor T7 is connected to a second internal node N. The thirteenth ASG transistor T13 includes a control terminal connected to a third internal node C connected to the second output node OT2, an input terminal connected to the twelfth ASG transistor T12, and an output terminal connected to the first voltage terminal VT1. The eighth ASG transistor T8 includes a control terminal connected to the third internal node C, an input terminal connected to the second internal node N, and an output terminal connected to the first voltage terminal VT1. The control terminal, the input terminal and the output terminal of the twelfth ASG transistor T12 may be a gate electrode, a source electrode and a drain electrode, respectively. Moreover, the control terminal, the input terminal and the output terminal of the seventh ASG transistor T7 may be a gate electrode, a source electrode and a drain electrode, respectively. Moreover, the control terminal, the input terminal and the output terminal of the thirteenth ASG transistor T13 may be a gate electrode, a source electrode and a drain electrode, respectively. Moreover, the control terminal, the input terminal and the output terminal of the eighth ASG transistor T8 may be a gate electrode, a source electrode and a drain electrode, respectively.

The first maintaining part 281 includes a third ASG transistor T3. The third ASG transistor T3 includes a control terminal connected to the second internal node N, an input terminal connected to the output node O and an output terminal connected to the first voltage terminal VT1. The first maintaining part 281 maintains a voltage of the output node O at the first gate off voltage VOFF1 in response to receipt of a control signal from the second internal node N during a gate output off interval. The control terminal, the input terminal and the output terminal of the third ASG transistor T3 may be a gate electrode, a source electrode and a drain electrode, respectively.

The n-th stage according to an exemplary embodiment may further include a second maintaining part 282, a third maintaining part 283, a fourth maintaining part 284 and a fifth maintaining part 285.

The second maintaining part 282 includes a tenth ASG transistor T10. The tenth ASG transistor T10 includes a control terminal connected to the second internal node N, an input terminal connected to the first internal node Q and an output terminal connected to the second voltage terminal VT2. The control terminal, the input terminal and the output terminal of the tenth ASG transistor T10 may be a gate electrode, a source electrode and a drain electrode, respectively.

The third maintaining part 283 includes a fifth ASG transistor T5. The fifth ASG transistor T5 includes a control terminal connected to the first input terminal IN1, an input terminal connected to the second internal node N and an output terminal connected to the second voltage terminal VT2. The control terminal, the input terminal and the output terminal of the fifth ASG transistor T5 may be a gate electrode, a source electrode and a drain electrode, respectively.

The fourth maintaining part 284 includes a sixth ASG transistor T6. The sixth ASG transistor T6 includes a control terminal connected to the third input terminal IN3, an input terminal connected to the first internal node Q and an output terminal connected to the second voltage terminal VT2. The control terminal, the input terminal and the output terminal of the sixth ASG transistor T6 may be a gate electrode, a source electrode and a drain electrode, respectively.

The fifth maintaining part 285 includes a seventeenth ASG transistor T17. The seventeenth ASG transistor T17 includes a control terminal connected to the second input terminal IN2, an input terminal connected to the third internal node C and an output terminal connected to the second voltage terminal VT2. The control terminal, the input terminal and the output terminal of the seventeenth ASG transistor T17 may be a gate electrode, a source electrode and a drain electrode, respectively.

Referring again to FIGS. 3, 4 and 6, when the vertical start control signal STV has the high level and the gate clock control signal CPVX has the low level (during periods TM1, TM2 and TM3), the gate clock signal CKVX has the compensated voltage VOFFL which is lower than the first gate off voltage VOFF1. Accordingly, an amplitude of the gate clock signal CKVX increases and a voltage which is bootstrapped at the first internal node Q also increases. In addition, the electric potential difference of the gate signal Gn outputted to the output node O increases.

According to at least one exemplary embodiment, when the vertical start control signal STY has the high level and the gate clock control signals CPV1, CPV2 and CPV3 have the low level, the gate clock signals CKV1, CKV2 and CKV3 have the compensated voltage VOFFL which is lower than the first gate off voltage VOFF1. Thus, the uniformity of the gate signal according to the gate line may be improved. Therefore, a display defect such as a horizontal line defect may be prevented so that the display quality of the display apparatus may be improved.

Figure 7:
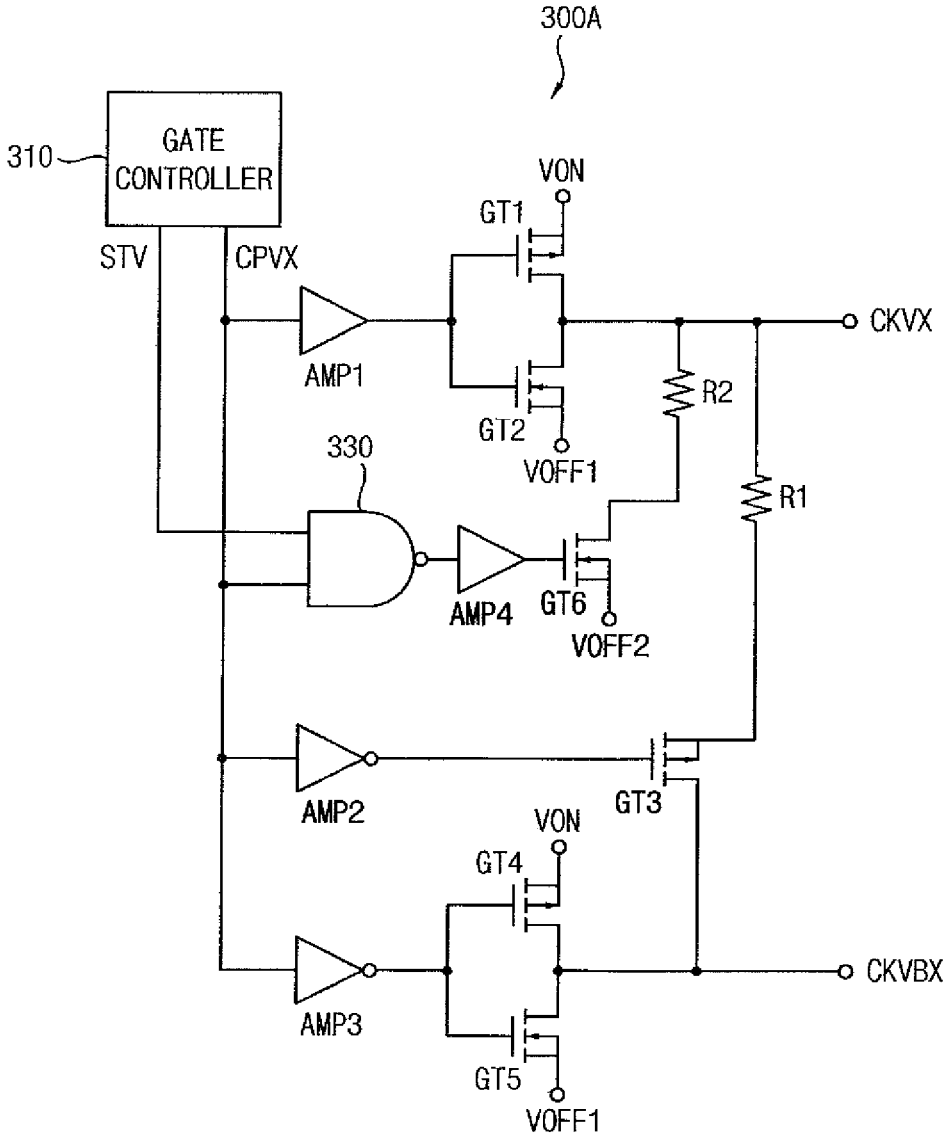
FIG. 7 is a block diagram illustrating a gate driver according to an exemplary embodiment of the present invention.

FIG. 7 is a block diagram illustrating a gate driver 300A according to an exemplary embodiment of the present invention. The gate driver 300 of the display apparatus of FIG. 1 may be replaced with the gate driver 300A of FIG. 7 in an exemplary embodiment of the display apparatus.

Thus, the display apparatus according to the present exemplary embodiment is substantially the same as the display apparatus of the previous exemplary embodiment explained with reference to FIGS. 1 to 6 except for a structure of the gate driver. Thus, the same reference numerals will be used to refer to the same or like parts as those described in the previous exemplary embodiment of FIGS. 1 to 6 and any repetitive explanation concerning the above elements will be omitted.

Referring to FIGS. 1, 2 and 7, the display apparatus includes a display panel 100, a timing controller 200, a gate driver 300A, a gate signal generator 350, a gamma reference voltage generator 400, a data driver 500 and a voltage generator 600.

The gate driver 300A generates a vertical start signal STVP, a plurality of gate clock signals CKVX and a plurality of inverse gate clock signal CKVBX based on the vertical start control signal STV, the gate clock control signals CPVX, the gate on voltage VON, the first gate off voltage VOFF1 and the second gate off voltage VOFF2.

The gate driver 300A includes a gate controller 310, a first amplifier AMP1, a second amplifier AMP2, a third amplifier AMP3, a first transistor GT1, a second transistor GT2, a third transistor GT3, a fourth transistor GT4 and a fifth transistor GT5.

The gate driver 300A may further include a fourth amplifier AMP4, a sixth transistor GT6 and a fourth amplifier controller 330.

The fourth amplifier controller 330 receives the vertical start control signal STV and the gate clock control signal CPVX from the gate controller 310.

The fourth amplifier controller 330 is connected to the gate controller 310 and the fourth amplifier AMP4 and controls an operation of the fourth amplifier AMP4.

In an exemplary embodiment, the fourth amplifier controller 330 is a NAND gate. The fourth amplifier controller 330 includes a first input terminal to which the vertical start control signal STV is applied and a second input terminal to which the gate clock control signal CPVX is applied.

When one of the vertical start control signal STV and the gate clock control signal CPVX has a low level, the fourth amplifier controller 330 outputs a high level signal.

The fourth amplifier AMP4 receives an amplifier control signal from the fourth amplifier controller 330. The fourth amplifier AMP4 amplifies the amplifier control signal and outputs the amplified amplifier control signal to the sixth transistor GT6.

The sixth transistor GT6 may be the N-type MOSFET. A gate electrode of the sixth transistor GT6 is connected to an output terminal of the fourth amplifier AMP4. The second gate off voltage VOFF2 is applied to a source electrode of the sixth transistor GT6. A drain electrode of the sixth transistor GT6 is connected to a first end of a second resistor R2. A second end of the second resistor R2 is connected to the terminal outputting the gate clock signal CKVX.

The second resistor R2 may be a variable resistor. The second resistor R2 may enable or disable the sixth transistor GT6 according to its variable resistance. For example, when the gate clock control signal CPVX has a low level and the vertical start control signal STV has a high level, the second resistor R2 enables the sixth transistor GT6. For example, when the gate clock control signal CPVX has a high level and the vertical start control signal STV has a low level, the second resistor R2 disables the sixth transistor GT6. For example, when the gate clock control signal CPVX has a low level and the vertical start control signal STV has a low level, the second resistor R2 disables the sixth transistor GT6.

According to at least one exemplary embodiment, when the vertical start control signal STV has the high level and the gate clock control signals CPV1, CPV2 and CPV3 have the low level, the gate clock signals CKV1, CKV2 and CKV3 have the compensated voltage VOFFL which is lower than the first gate off voltage VOFF1. Thus, the uniformity of the gate signal according to the gate line may be improved. Therefore, a display defect such as a horizontal line defect may be prevented so that the display quality of the display apparatus may be improved.

Figure 8:
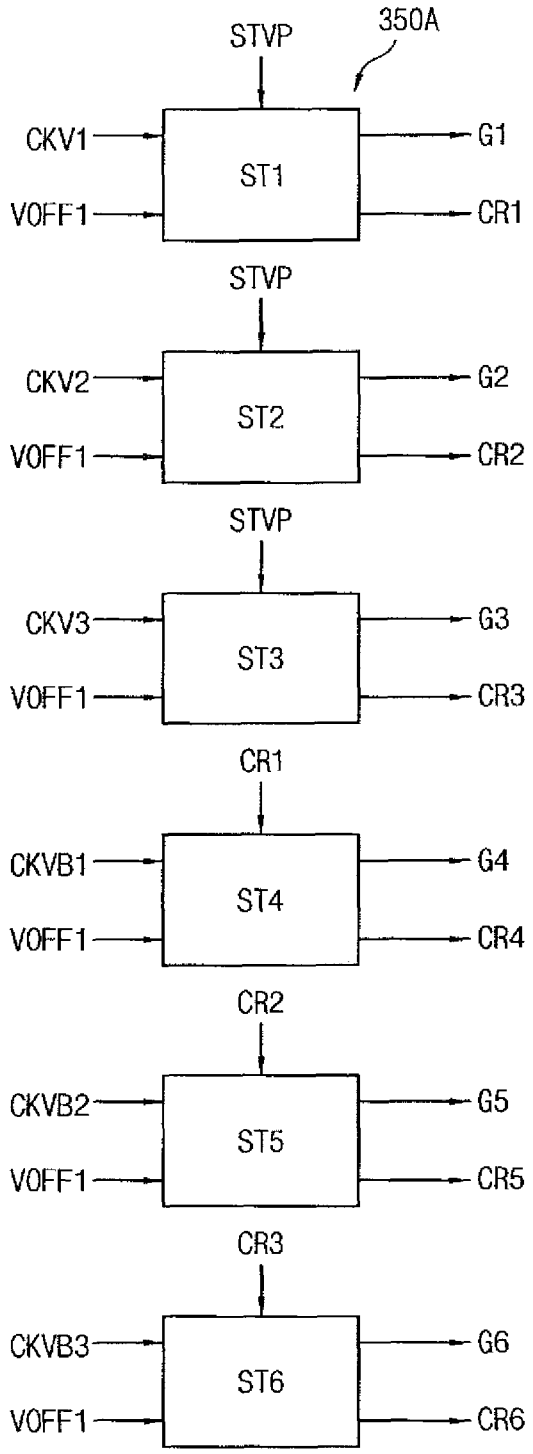
FIG. 8 is a block diagram illustrating a gate signal generator according to an exemplary embodiment of the present invention.

FIG. 8 is a block diagram illustrating a gate signal generator 350A according to an exemplary embodiment of the present invention. The gate signal generator 350 of the display apparatus of FIG. 1 may be replaced with the gate signal generator 350A of FIG. 8 in an exemplary embodiment of the display apparatus.

Thus, the display apparatus according to the present exemplary embodiment is substantially the same as the display apparatus of the previous exemplary embodiment explained referring to FIGS. 1 to 6 except that the first gate off voltage VOFF1 is applied to the gate signal generator and the second gate off voltage VOFF2 is not applied to the gate signal generator. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 4 and 8, the display apparatus includes a display panel 100, a timing controller 200, a gate driver 300, a gate signal generator 350A, a gamma reference voltage generator 400, a data driver 500 and a voltage generator 600.

The gate signal generator 350A includes a plurality of stages connected to each other.

In an exemplary embodiment, the gate signal generator 350A receives the first gate off voltage VOFF1 from the voltage generator 600.

The stages output the gate signals G1 to G6 and carry signals CR1 to CR6 based on the gate clock signals CKV1 to CKV3 or the inverse gate clock signals CKVB1 to CKVB3 and the first gate off voltage VOFF1.

Figure 9:
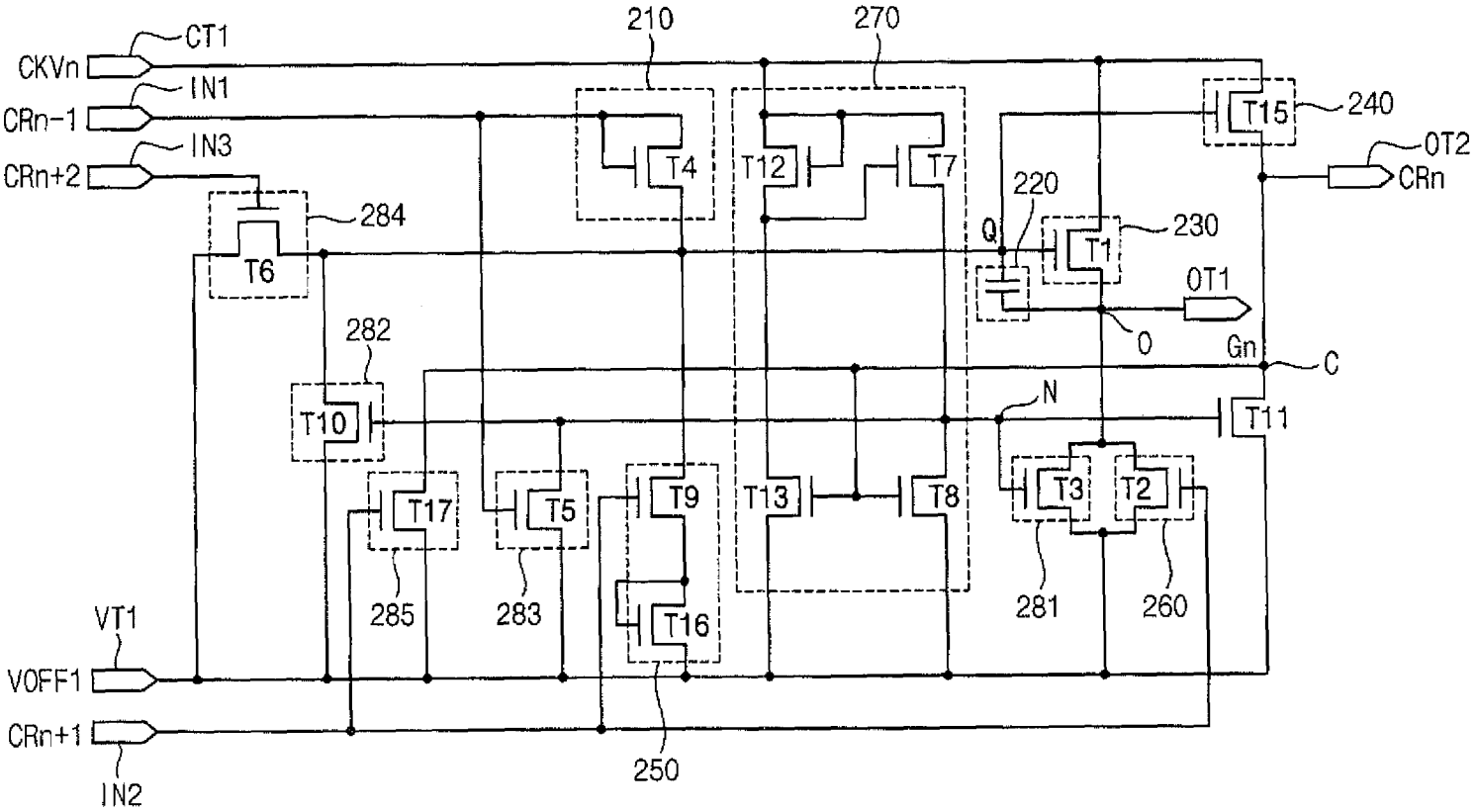
FIG. 9 is an equivalent circuit diagram illustrating an N-th stage of the gate signal generator of FIG. 8 according to an exemplary embodiment of the invention.

FIG. 9 is an equivalent circuit diagram illustrating an N-th stage of the gate signal generator 350A of FIG. 8 according to an exemplary embodiment of the invention.

Referring to FIGS. 1 to 4, 8 and 9, the n-th stage according to the present exemplary embodiment includes a buffer part 210, a charging part 220, a pull-up part 230, a carry part 240, a discharging part 250, a pull-down part 260, a switching part 270 and a first maintaining part 281. The n-th stage may further include a second maintaining part 282, a third maintaining 283, a fourth maintaining 284 and a fifth maintaining 285.

An output terminal of a sixth ASG transistor T6 is connected to a first voltage terminal VT1 to which the first gate off voltage VOFF1 is applied. An output terminal of a tenth ASG transistor T10 is connected to the first voltage terminal VT1. An output terminal of a seventeenth ASG transistor T17 is connected to the first voltage terminal VT1. An output terminal of a fifth ASG transistor T5 is connected to the first voltage terminal VT1. An output terminal of a sixteenth ASG transistor T16 is connected to the first voltage terminal VT1. An output terminal of an eleventh ASG transistor T11 is connected to the first voltage terminal VT1.

According to at least one exemplary embodiment, when the vertical start control signal STY has the high level and the gate clock control signals CPV1, CPV2 and CPV3 have the low level, the gate clock signals CKV1, CKV2 and CKV3 have the compensated voltage VOFFL which is lower than the first gate off voltage VOFF1. Thus, the uniformity of the gate signal according to the gate line may be improved. Therefore, a display defect such as a horizontal line defect may be prevented so that the display quality of the display apparatus may be improved.

According to at least one embodiment of the present invention, the level of the gate signal is adjusted so that the display quality of the display apparatus may be improved.

The foregoing is illustrative of the present invention and is not to be construed as limiting thereof. Although a few exemplary embodiments of the present invention have been described, many modifications are possible in the exemplary embodiments without materially departing from the present invention. Accordingly, all such modifications are intended to be included within the scope of the present invention. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the invention.

What is claimed is:

1. A gate driving module comprising:

a gate driver configured to generate a vertical start signal, a plurality of gate clock signals and a plurality of inverse gate clock signals based on a vertical start control signal, a plurality of gate clock control signals, a gate on voltage, a first gate off voltage and a second gate off voltage, the number of the gate clock signals being P, the number of the inverse gate clock signals being P, the number of the gate clock control signals being P, P being a positive integer equal to or greater than two; and a gate signal generator configured to generate a gate signal based on the vertical start signal, the gate clock signals and the inverse gate clock signals, wherein the gate on voltage, the first gate off voltage, and the second gate off voltage differ from one another, and each gate clock signal is based on the gate on voltage, the first gate off voltage, and the second gate off voltage, wherein each gate clock signal has the gate on voltage during a high level duration when the vertical start control signal has a high level, and lengths of the high level durations differ from one another.

2. The gate driving module of claim 1, wherein each gate clock signal has the first gate off voltage during a first low level duration and a compensated voltage which is less than the first gate off voltage and equal to or greater than the second gate off voltage during a second low level duration.

3. The gate driving module of claim 2, wherein each gate clock signal has the compensated voltage during the second low level duration when the vertical start control signal has the high level and a corresponding one of the gate clock control signals has a low level.

4. The gate driving module of claim 1, wherein the gate driver comprises:

a gate controller;

a first amplifier connected to the gate controller;

first and second transistors connected to the first amplifier and configured to output the gate clock signals;

a second amplifier connected to the gate controller;

a third transistor connected to the second amplifier;

a third amplifier connected to the gate controller; and fourth and fifth transistors connected to the third amplifier and configured to output the inverse gate clock signals.

5. The gate driving module of claim 4, wherein the gate driver further comprises:

a fourth amplifier;

a sixth transistor connected to the fourth amplifier and the first and second transistors; and an amplifier controller connected to the gate controller and the fourth amplifier, wherein the amplifier controller is configured to control an operation of the fourth amplifier.

6. The gate driving module of claim 5, wherein the amplifier controller comprises an RS latch including a set terminal to which the vertical start control signal is applied and a reset terminal to which the gate clock control signals are applied.

7. The gate driving module of claim 5, wherein the amplifier controller comprises a NAND gate to which the vertical start control signal and the gate clock control signals are applied.

8. The gate driving module of claim 1, wherein the gate signal generator comprises a plurality of stages connected to each other, and each stage outputs the gate signal and a carry signal based on a corresponding one of the gate clock signals, the first gate off voltage and the second gate off voltage.

9. The gate driving module of claim 8, wherein an n-th stage among the stages comprises:

a buffer part configured to apply a carry signal from a previous stage to a first node in response to the carry signal;

a pull-up part configured to output the one gate clock signal as an n-th gate signal in response to a signal applied to the first node;

a carry part configured to output the one gate clock signal as an n-th carry signal in response to the signal applied to the first node; and a pull-down part configured to pull down the n-th gate signal in response to a carry signal from a next stage, and n is a positive integer.

10. The gate driving module of claim 8, wherein, when p is 3, a first gate clock signal is applied to a first stage, a second gate clock signal is applied to a second stage adjacent to the first stage, a third gate clock signal is applied to a third stage adjacent to the second stage, a first inverse gate clock signal which is inverted from the first gate clock signal is applied to a fourth stage adjacent to the third stage, a second inverse gate clock signal which is inverted from the second gate clock signal is applied to a fifth stage adjacent to the fourth stage and a third inverse gate clock signal which is inverted from the third gate clock signal is applied to a sixth stage adjacent to the fifth stage.

11. The gate driving module of claim 10, wherein, a first carry signal of the first stage is applied to the fourth stage, a second carry signal of the second stage is applied to the fifth stage and a third carry signal of the third stage is applied to the sixth stage.

12. A display apparatus comprising:

a display panel configured to display an image;

a gate driving module comprising a gate driver and a gate signal generator, the gate driver configured to generate a vertical start signal, a plurality of gate clock signals and a plurality of inverse gate clock signals based on a vertical start control signal, a plurality of gate clock control signals, a gate on voltage, a first gate off voltage and a second gate off voltage, the number of the gate clock signals being P, the number of the inverse gate clock signals being P, the number of the gate clock control signals being P, P being a positive integer equal to or greater than two, the gate signal generator configured to generate a gate signal based on the vertical start signal, the gate clock signals and the inverse gate clock signals and output the gate signal to the display panel; and a data driver configured to generate a data voltage and output the data voltage to the display panel, wherein the gate on voltage, the first gate off voltage, and the second gate off voltage differ from one another, and each gate clock signal is based on the gate on voltage, the first gate off voltage, and the second gate off voltage, wherein each gate clock signal has the gate on voltage during a high level duration when the vertical start control signal has a high level and lengths of the high level durations differ from one another.

13. The display apparatus of claim 12, wherein each gate clock signal has the first gate off voltage during a first low level duration and a compensated voltage which is less than the first gate off voltage and equal to or greater than the second gate off voltage during a second low level duration.

14. The display apparatus of claim 13, wherein each gate clock signal has the compensated voltage during the second low level duration when the vertical start control signal has the high level and a corresponding one of the gate clock control signals has a low level.

15. The display apparatus of claim 12, wherein the gate driver comprises:

a gate controller;

a first amplifier connected to the gate controller;

first and second transistors connected to the first amplifier and configured to output the gate clock signals;

a second amplifier connected to the gate controller;

a third transistor connected to the second amplifier;

a third amplifier connected to the gate controller; and fourth and fifth transistors connected to the third amplifier and configured to output the inverse gate clock signals.

16. The display apparatus of claim 15, wherein the gate driver further comprises:

a fourth amplifier;

a sixth transistor connected to the fourth amplifier and the first and second transistors; and an amplifier controller connected to the gate controller and the fourth amplifier, wherein the amplifier controller is configured to control an operation of the fourth amplifier.

17. The display apparatus of claim 12, wherein the gate signal generator is integrated on the display panel.

18. A method of driving a display panel, the method comprising:

generating a vertical start signal, a plurality of gate clock signals and a plurality of inverse gate clock signals based on a vertical start control signal, a plurality of gate clock control signals, a gate on voltage, a first gate off voltage and a second gate off voltage, the number of the gate clock signals being P, the number of the inverse gate clock signals being P, the number of the gate clock control signals being P, P being a positive integer equal to or greater than two; and generating a gate signal based on the vertical start signal, the gate clock signals and the inverse gate clock signals, wherein the gate on voltage, the first gate off voltage, and the second gate off voltage differ from one another, and each gate clock signal is based on the gate on voltage, the first gate off voltage, and the second gate off voltage, wherein each gate clock signal has the gate on voltage during a high level duration when the vertical start control signal has a high level and lengths of the high level durations differ from one another.

19. The method of claim 18, wherein each gate clock signal has the first gate off voltage during a first low level duration and a compensated voltage which is less than the first gate off voltage and equal to or greater than the second gate off voltage during a second low level duration.

20. The method of claim 19, wherein each gate clock signal has the compensated voltage during the second low level duration when the vertical start control signal has the high level and a corresponding one of the gate clock control signals has a low level.

21. A gate driving module comprising:

a gate controller configured to output a vertical start control signal and a plurality of gate clock control signals;

a first amplifier configured to receive the gate clock control signals as input;

first and second transistors connected to the first amplifier and configured to output gate clock signals;

a second amplifier configured to receive the gate clock control signals as input;

a third transistor connected to the second amplifier;

a third amplifier configured to receive the gate clock control signals as input;

fourth and fifth transistors connected to the third amplifier and configured to output inverse gate clock signals;

a fourth amplifier; and a sixth transistor connected to the fourth amplifier and the first and second transistors, wherein each of the gate clock control signals have a low level during a period the vertical start control signal has a high level, and durations of the low levels all differ from one another.

22. The gate driving module of claim 21, wherein the first transistor is connected to a gate on voltage, the second transistor is connected to a first gate off voltage, the sixth transistor is connected to a second gate off voltage, the fourth transistor is connected to the gate on voltage, and the fifth transistor is connected to first gate off voltage.

23. The gate driving module of claim 22, wherein the gate on voltage is higher than the gate off voltages and the second gate off voltage is lower than the first gate off voltage.

24. The gate driving module of claim 21, further comprising:

a first resistor connecting the third transistor to a node connected to both the first and second transistors; and a second resistor connecting the sixth transistor to the same node.

25. The gate driving module of claim 21, further comprising an amplifier controller configured to receive the gate clock control signals and the vertical start control signal as inputs and provide an output to the fourth amplifier.

* * * * *